US009512965B2

(12) United States Patent
Acklin

(10) Patent No.: US 9,512,965 B2
(45) Date of Patent: Dec. 6, 2016

(54) METHOD AND DEVICE FOR REMOVING WATER FROM A SWIMMING POOL COVER

(71) Applicant: Joseph T. Acklin, Carmel, IN (US)

(72) Inventor: Joseph T. Acklin, Carmel, IN (US)

( * ) Notice: Subject to any disclaimer, the term of this patent is extended or adjusted under 35 U.S.C. 154(b) by 529 days.

(21) Appl. No.: 13/967,033

(22) Filed: Aug. 14, 2013

(65) Prior Publication Data

US 2015/0047713 A1 Feb. 19, 2015

(51) Int. Cl.

| | |
|---|---|
| ***E04H 4/00*** | (2006.01) |
| ***F17D 1/14*** | (2006.01) |
| ***E04H 4/16*** | (2006.01) |
| *E04H 4/10* | (2006.01) |

(52) U.S. Cl.

CPC *F17D 1/14* (2013.01); *E04H 4/16* (2013.01); *E04H 4/10* (2013.01); *Y10T 137/0402* (2015.04); *Y10T 137/85978* (2015.04)

(58) Field of Classification Search

USPC ..... 4/498

See application file for complete search history.

(56) References Cited

U.S. PATENT DOCUMENTS

| | | | | |
|---|---|---|---|---|
| 2,772,421 | A * | 12/1956 | Friend | A61H 33/6026 4/541.3 |
| 3,579,657 | A * | 5/1971 | Gurrieri | E04H 4/10 210/474 |
| D328,748 | S * | 8/1992 | Eng | 137/135 |
| 5,255,398 | A | 10/1993 | Flynn et al. | |
| 5,624,238 | A | 4/1997 | Herbert | |
| 5,802,653 | A | 9/1998 | Roumagnac | |
| 6,022,481 | A | 2/2000 | Blake | |
| 6,094,764 | A | 8/2000 | Veloskey et al. | |
| 6,438,766 | B1 | 8/2002 | Capdevila Arnau et al. | |
| 6,463,943 | B1 | 10/2002 | Monroe | |
| 6,954,948 | B1 | 10/2005 | Asack et al. | |
| 7,311,823 | B2 | 12/2007 | Brooke | |
| 7,614,355 | B2 | 11/2009 | Zeyger | |
| 2006/0143818 | A1 | 7/2006 | Bickmore et al. | |
| 2006/0265820 | A1 | 11/2006 | Erlich et al. | |

(Continued)

OTHER PUBLICATIONS

Miller, Nathaniel, How to Use a Submersible Utility Pump, E-How, http://www.ehow.com/how_4827717_use-submersible-utility-pump.html, May 24, 2013.

(Continued)

*Primary Examiner* — Huyen Le

(74) *Attorney, Agent, or Firm* — Bruce J. Bowman

(57) ABSTRACT

A device and method is provided for removing water that has accumulated on a swimming pool cover in the form of a directed stream or spray from a typical pool cover pump through a water ejection spout. The water ejection spout has a connector adapted to couple to an outflow connector of the pool cover pump, tubing extending from the connector, and a nozzle coupled to the tubing for expelling the pumped water. The water ejection spout is configured to discharge the pumped water in a directed stream or spray upwardly and outwardly from the pool cover pump. The tubing and nozzle may be configured to additionally discharge the pumped water in a directed stream or spray away from the pool pump, or another in a directed stream or spray over the pool pump. One form is configured to inhibit rotation and/or tipping of the pump/spout assembly.

18 Claims, 10 Drawing Sheets

(56) References Cited

U.S. PATENT DOCUMENTS

2008/0166244 A1* 7/2008 Winge ..... F04D 13/02
417/234

OTHER PUBLICATIONS

Intex 2500 GPH Above Ground Swimming Pool Pump & Filter, ebay, http://www.ebay.com.au/itm/Intex-2500-Above-Ground-Swimming...html, May 24, 2013.
Submersible Drought Garden Water Butt Pool Pump, ebay, http://www.ebay.co.uk/itm/Submersible-Drought-Water-Butt-Pump...htm, May 24, 2013.
Swim Jet Counterflow Swimming, ipoolsupplies, http://www.ipoolsupplies.com/Counterflow-swimming.html, May 24, 2013.
Swimming Pool Plastering Do-It-Yourself Project, truetex, http://www.truetex.com/pool.html, May 24, 2013.

* cited by examiner

METHOD AND DEVICE FOR REMOVING WATER FROM A SWIMMING POOL COVER

FIELD OF THE INVENTION

The present invention relates to methods and devices for removing water from a swimming pool cover and, more particularly, to methods and devices for removing water from a swimming pool cover using a swimming pool cover pump.

BACKGROUND

Many swimming pools have covers for keeping dirt, debris and other undesirable elements from getting into the pool. Covers also keep children from falling into the pool when the pool is unattended, and unauthorized people from entering the pool. Covers are thus made to withstand substantial weight so that if someone were to fall or walk onto the cover it would hold their weight.

However, because of the various purposes of a swimming pool cover, they are made such that they are impermeable to water. Therefore, water, generally because of rain, accumulates on the swimming pool cover. In order to use the swimming pool, any water on the cover must first be removed before the cover can be manually taken off or automatically rolled back. The prior art manner of removing water from a pool cover is to use a pool cover pump.

FIG. 1 shows a typical swimming pool 10 with a cover 12. While the cover 12 is shown as an automatic type pool cover, it should be appreciated that the same prior art method applies to manual type pool covers. An accumulation of water 14 is shown on the cover 12. A typical pool cover pump 16 has been placed in the accumulation of water 14. The pool cover pump 16 operates via electricity and thus includes a power cord 17 that is connected to a source of electricity (not shown). The pump 16 has a connector 19 through which the water is pumped. The pump connector 19 is configured (i.e. threaded) such that a typical hose 18 can be connected to the pump 16. This setup guides the accumulated water 14 from the cover 12 and out the hose 18.

While the prior art manner of removing water from a swimming pool cover certainly works, there are many associated hassles, particularly with the hose and the water being removed. First, a hose of sufficient length to channel the water to a desired outflow area must be connected to the pool cover pump, and secondly, the hose 18 must be connected to the pool cover pump, stretched out and appropriately placed such that the pumped water flows into the desired outflow area. This procedure must be accomplished every time accumulated water is removed from the pool cover.

Moreover, the water being removed flows from the hose 18 in a large continuous stream. As such, the continuous stream of water from the hose is not well suited for anything other than wasting the water. If the hose is placed such that the continuous stream of water outflows into a yard, the outflow area will quickly become saturated.

In view of the above, what is therefore needed is a better manner of removing accumulated water from a swimming pool cover.

SUMMARY OF THE INVENTION

The present invention is a device and method of removing accumulated water from a swimming pool cover that ejects, expels and/or disperses outflowing water from a pool cover pump in the form of a directed stream or spray.

The device comprises a water ejection spout having a connector adapted to couple to an outflow connector of a pool cover pump, tubing extending from the connector, and a nozzle coupled to the tubing and having an orifice for expelling water being pumped by the pool cover pump, the tubing and nozzle configured to discharge the pumped water in a directed stream or spray upwardly and outwardly from the pool cover pump.

In one form, the tubing and nozzle are configured to additionally discharge the pumped water in a directed stream or spray away from the pool pump.

In another form, the tubing and nozzle are configured to additionally discharge the pumped water in a directed stream or spray over the pool pump.

The tubing may comprise one or more tube sections. Additionally, the tubing may include one or more angled portions.

The method of removing accumulated water from a swimming pool cover includes providing a water ejection spout as described herein, attaching the provided water ejection spout to a pool cover pump, and activating the pool cover pump.

DETAILED DESCRIPTION

Figure 1:
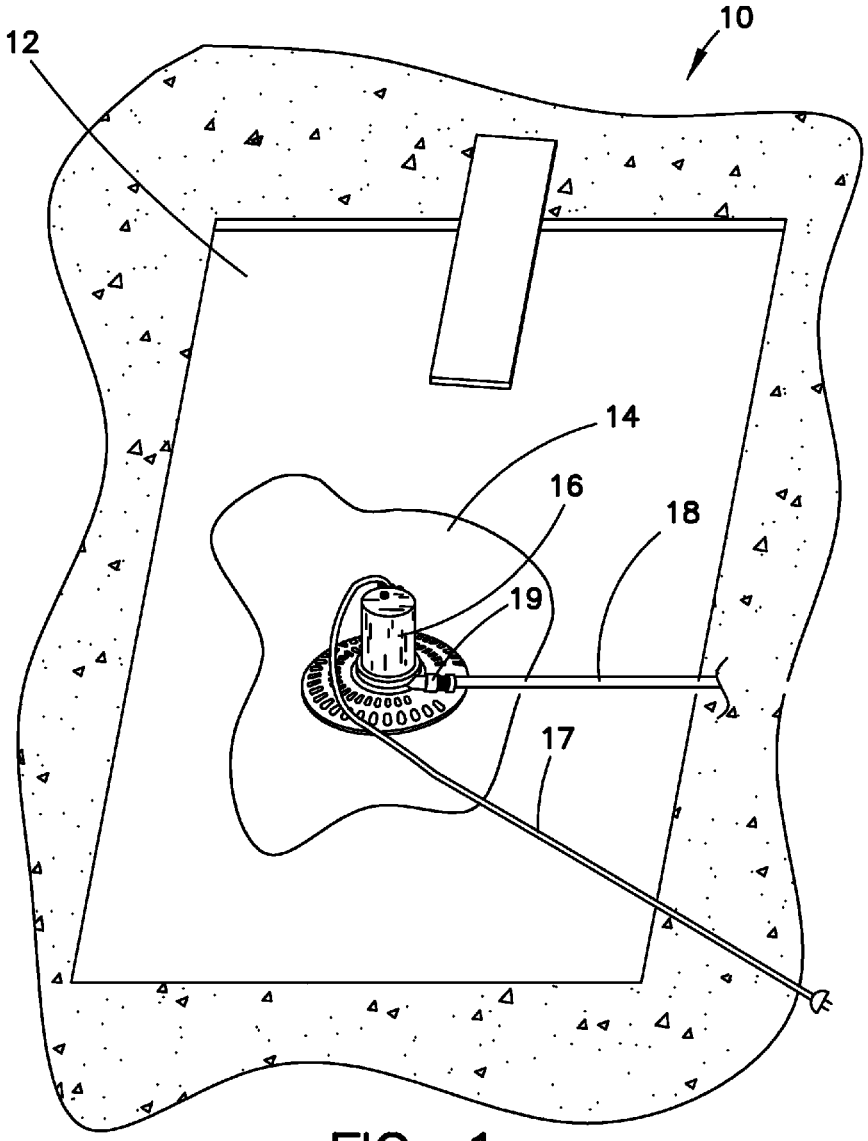
FIG. 1 (PRIOR ART)
FIG. 1 is an illustration of a prior art manner of removing water from a pool cover using a pool cover pump.
Figure 2:
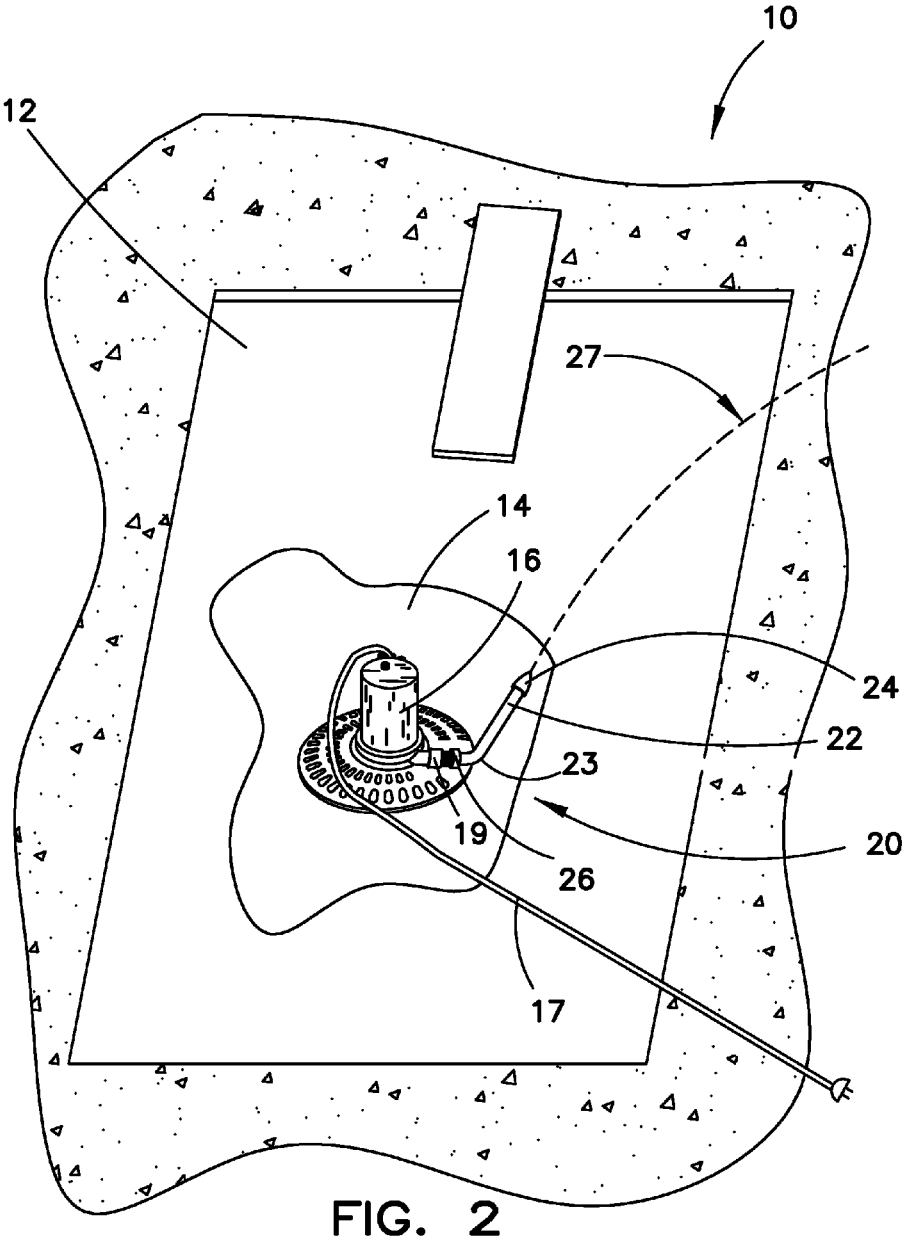
FIG. 2 is an illustration of a manner of removing water from a pool cover using a pool cover pump in accordance with the principles of the present invention, the present manner of removing water from a pool cover using a water ejection spout.

Referring to FIG. 2, there is shown the typical swimming pool 10 with a cover 12 as depicted in FIG. 1. While the cover 12 is shown as an automatic type pool cover, it should be appreciated that the present method and associated device applies to manual type pool covers. An accumulation of water 14 is shown on the cover 12. A typical pool cover pump 16 has been placed in the accumulation of water 14. The pool cover pump 16 operates via electricity and thus includes a power cord 17 that is connected to a source of electricity (not shown). The pump 16 includes a connector 19 through which the accumulated water is pumped.

In accordance with the principles of the present invention, an exemplary embodiment of a water ejection spout 20 is connected to the pool cover pump 16. The water ejection spout 20 is configured to expel and/or disperse the accumulated water in a stream 27. The water ejection spout 20 includes a length of tube/tubing, conduit, pipe/piping, or the like (collectively, tube) 22 that is preferably, but not necessarily, made from a plastic such as PVC. Other types of plastic and materials may be used if desired. Moreover, the tube 22 may be semi-rigid or bendable if desired. The length of tube 22 projects upwardly and outwardly from an angled portion 23 which in turn, is coupled to a connector 26. The connector 26 is threaded for attachment to the pump connector 19. A nozzle 24 is situated at an end of the tube 22. The nozzle 24 is configured to eject, expel and/or disperse the outflowing stream of water 27 a distance away from the pool 10 and the pool cover 12. As such, the stream of water 27 is well suited for watering the lawn, directing the water to a desired outflow area, or otherwise controllably discharging the pumped water.

Because the water ejection spout 20 is rigid (or at least semi-rigid) the pool pump 16 and thus the water ejection spout 20 is easily positionable on the pool cover 12 such that the direction of the water stream 27 is easily controlled. Thus, instead of moving a cumbersome hose, only the pool pump 16 needs to be turned or otherwise positioned in order to direct the water stream 27 as desired.

Figure 3:
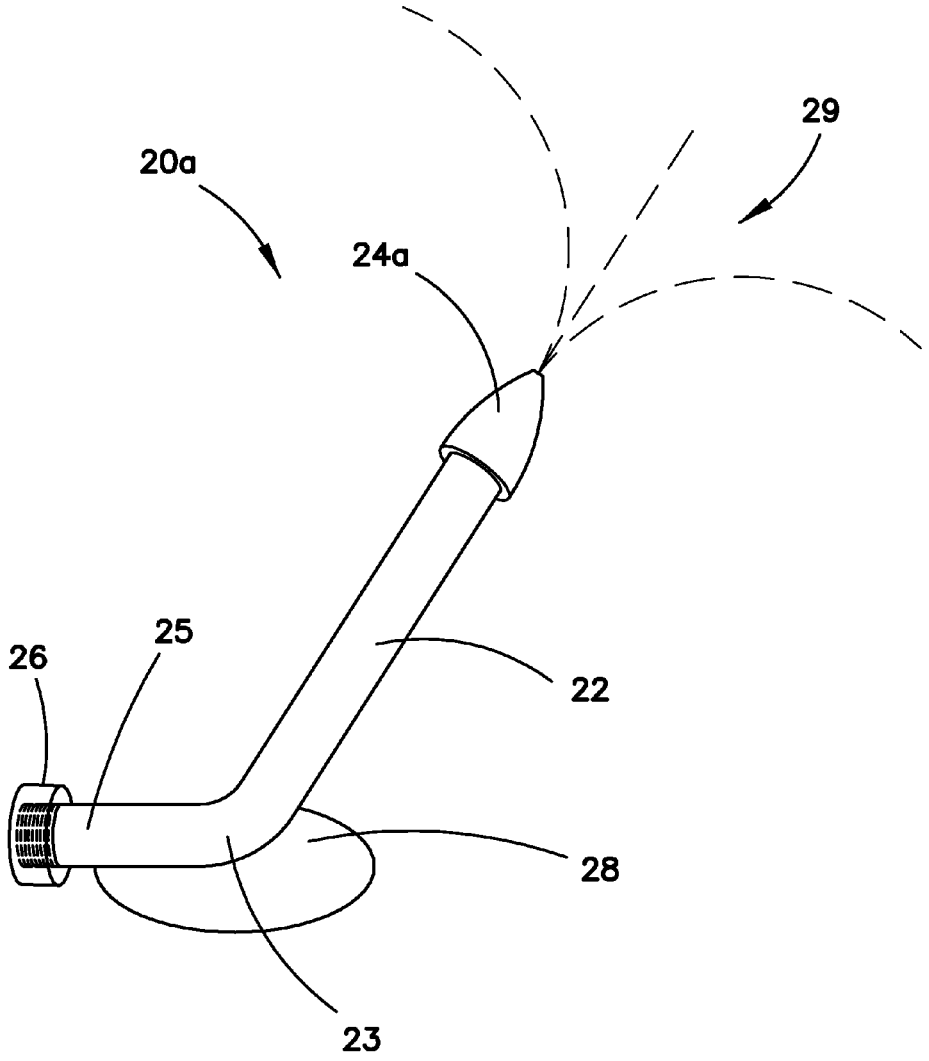
FIG. 3 is another embodiment of a water ejection spout fashioned in accordance with the present principles.

Referring now to FIG. 3, there is depicted another embodiment of a water ejection spout 20*a* fashioned in accordance with the present principles that is connectable to the pool cover pump 16 (not shown in FIG. 3). The water ejection spout 20*a* is configured to expel and/or disperse the accumulated water in a spray 29. The water ejection spout 20*a* includes the length of tube 22 like the water ejection spout 20. The length of tube 22 projects upwardly and outwardly from the angled portion 23 which in turn, is coupled to the connector 26 via an extended length of tube 25. The connector 26 is threaded for attachment to the pump connector 19. A nozzle 24*a* is again situated at an end of the tube 22. The nozzle 24*a* is configured to eject, expel and/or disperse the outflowing spray of water 29 a distance away from the pool 10 and the pool cover 12. As such, the spray of water 29 is well suited for watering the lawn, directing the water to a desired outflow area, or otherwise controllably discharging the pumped water.

The water ejection spout 20*a* includes a base 28 on which the extended length of tube 25 and the angled portion 23 rests. The base 28 provides extra stability to the water ejection spout 20 to inhibit and/or prevent it from tipping over. Because the water ejection spout 20*a* is rigid (or at least semi-rigid) the pool pump 16 and thus the water ejection spout 20*a* is easily positionable on the pool cover 12 such that the direction of the water spray 29 is easily controlled. Thus, instead of moving a cumbersome hose, only the pool pump 16 needs to be turned or otherwise positioned in order to direct the water spray 29 as desired.

Figure 4:
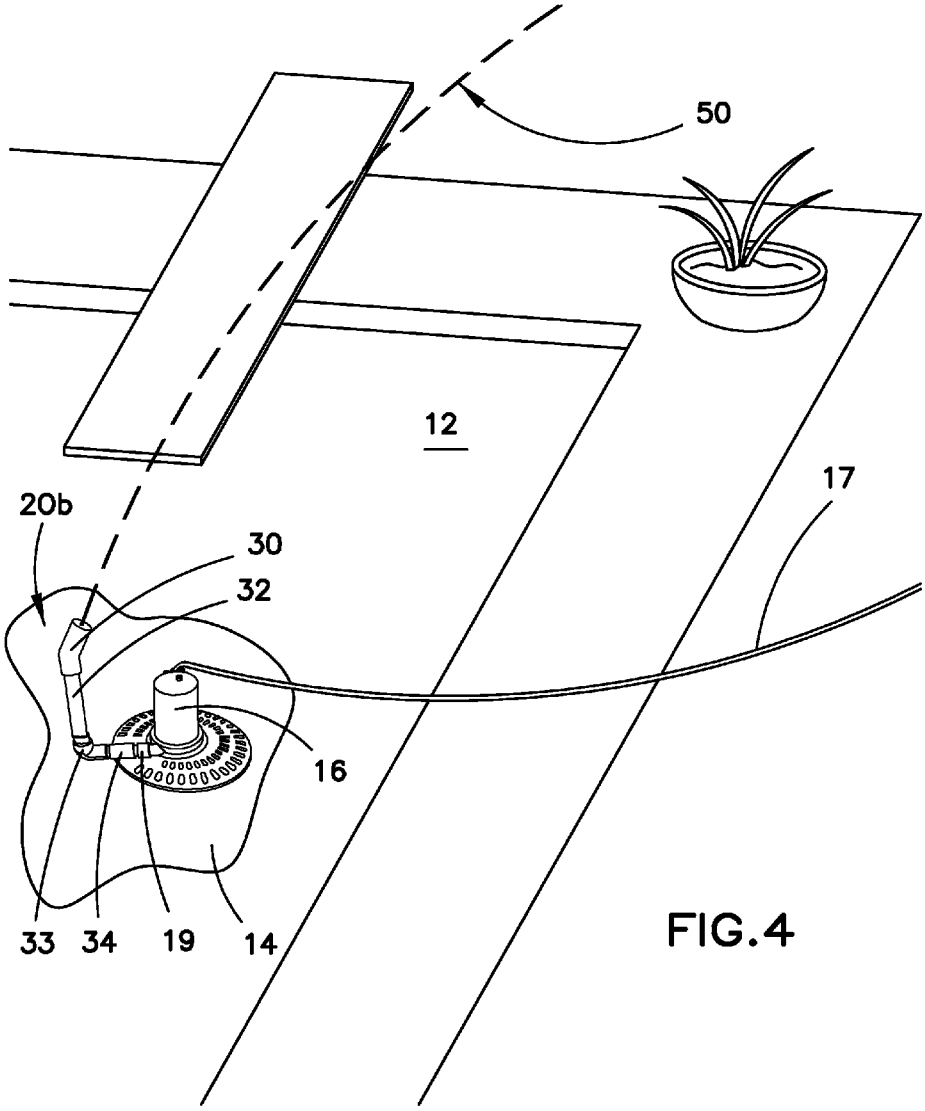
FIG. 4 is an illustration of the present manner of removing water from a pool cover using a pool cover pump with another embodiment of a water ejection spout.
Figure 5:
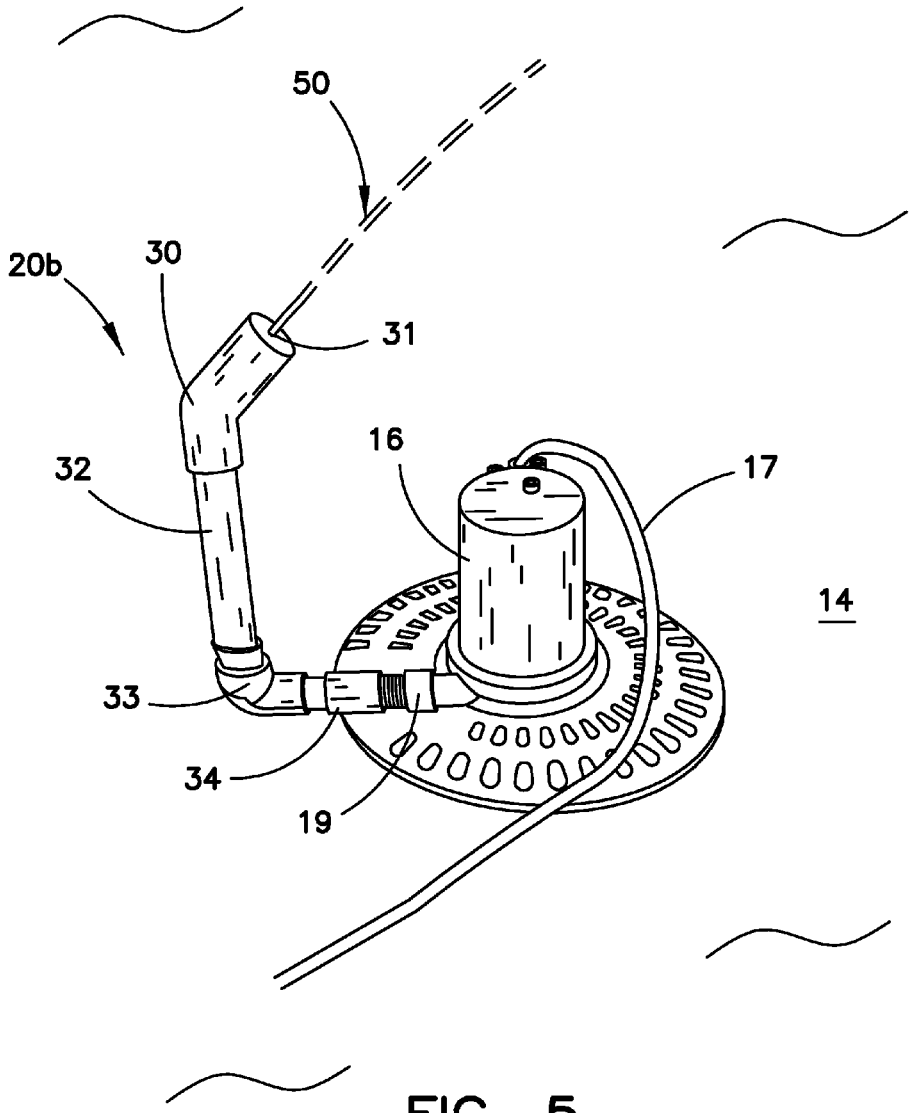
FIG. 5 is an enlarged view of the water ejection spout connected to the pool cover pump as shown in FIG. 4.

Referring now to FIGS. 4 and 5, there is shown another exemplary embodiment of a water ejection spout 20*b* fashioned in accordance with the present principles that is connectable to the pool cover pump 16. The water ejection spout 20*b* is configured to expel and/or disperse the accumulated water in a stream 50. In this embodiment, rather than expelling the water upwardly, outwardly and away from the pump as per the water ejection spouts 20 and 20*a*, the water is expelled upwardly, away and over the pool pump 16. This helps to inhibit or prevent the force of the expelled water from rotating or otherwise affecting the position of the pump 16.

The water ejection spout 20*b* includes connector 34 that is configured for threaded connection with the pump connector 19. An elbow 33, providing a right angle joint, is attached to the end of the connector 34. A length of tube 32 projects upwardly from the elbow 33. A nozzle 30 having a nozzle opening 31 is situated at an end of the tube 32. The nozzle 30 is angled such that the ejected outflowing stream of water 50 flows upwardly, outwardly and over the pump 16 a distance away from the pool 10 and the pool cover 12. As such, the stream of water 50 is again well suited for watering the lawn, directing the water to a desired outflow area, or otherwise controllably discharging the pumped water. The direction of the ejected stream of water 50 counteracts any force exerted on the spout 20*b* and the pump 16 such that the pump 16 will not rotate or be moved thereby.

Figure 6:
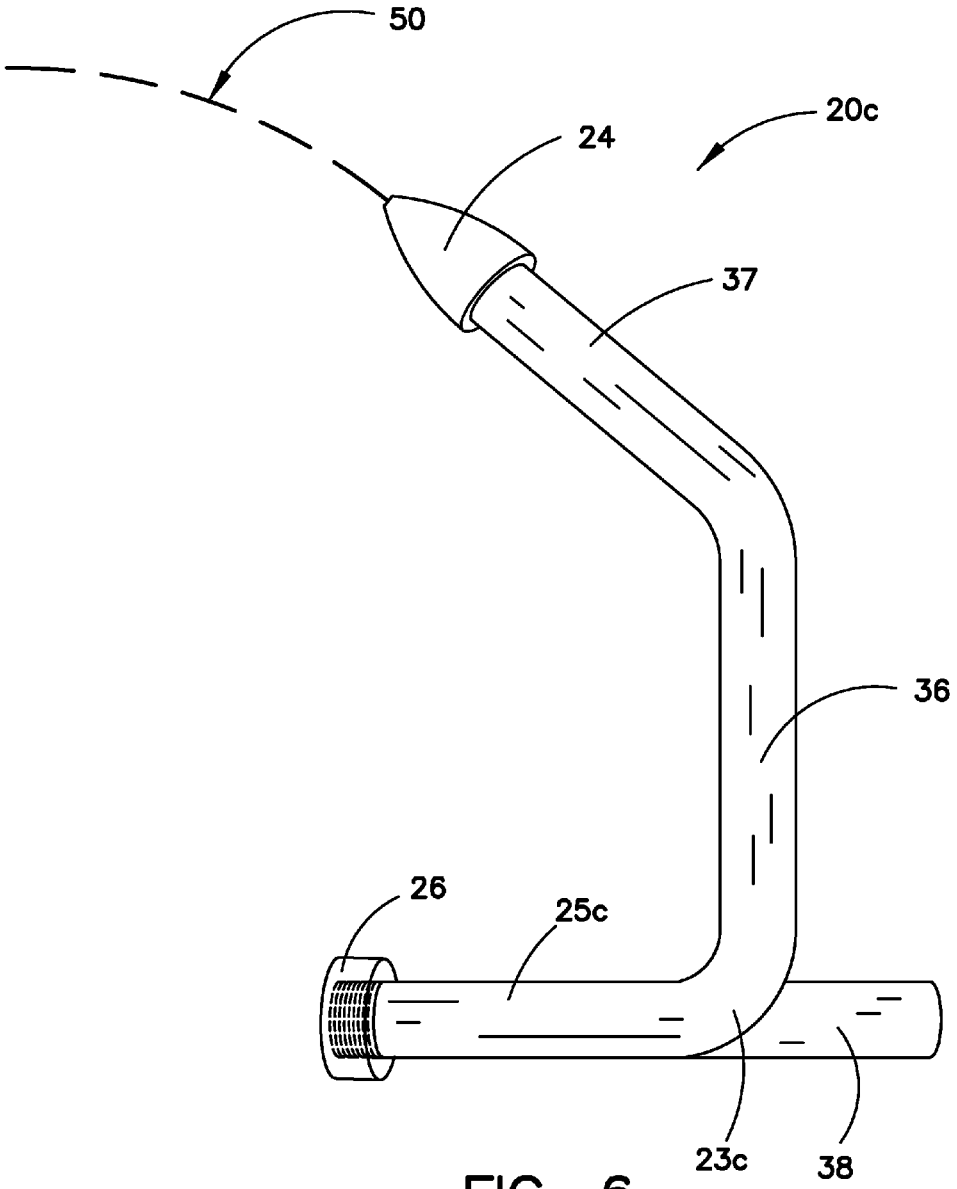
FIG. 6 is an enlarged view of another embodiment of a water ejection spout fashioned in accordance with the present principles.

Referring now to FIG. 6, there is depicted yet another exemplary embodiment of a water ejection spout 20*c* fashioned in accordance with the present principles that is connectable to the pool cover pump 16 (not shown in FIG. 6). The water ejection spout 20*c*, like the water ejection spout 20*b*, ejects, expels and/or disperses the water upwardly, away and over the pool pump 16. The water ejection spout 20*c* has a threaded connector 26 for connection to the pump connector, a straight length of tube 25*c* coupled to the connector 26, an angled portion 23*c* that provides a generally 90° bend, a second straight length of tube 36 extending upwardly from the angled portion 23*c*, and a third straight length of tube 37 that extends from the second length of tube 36 at an angle such that the nozzle 24 ejects a stream of water 50 upwardly, away from and over the pump (not shown in FIG. 6). The water ejection spout 20*c* further includes an extension 38 that projects from the straight length of tube 25*c* to provide stability to the water ejection spout 20*c*.

Figure 7:
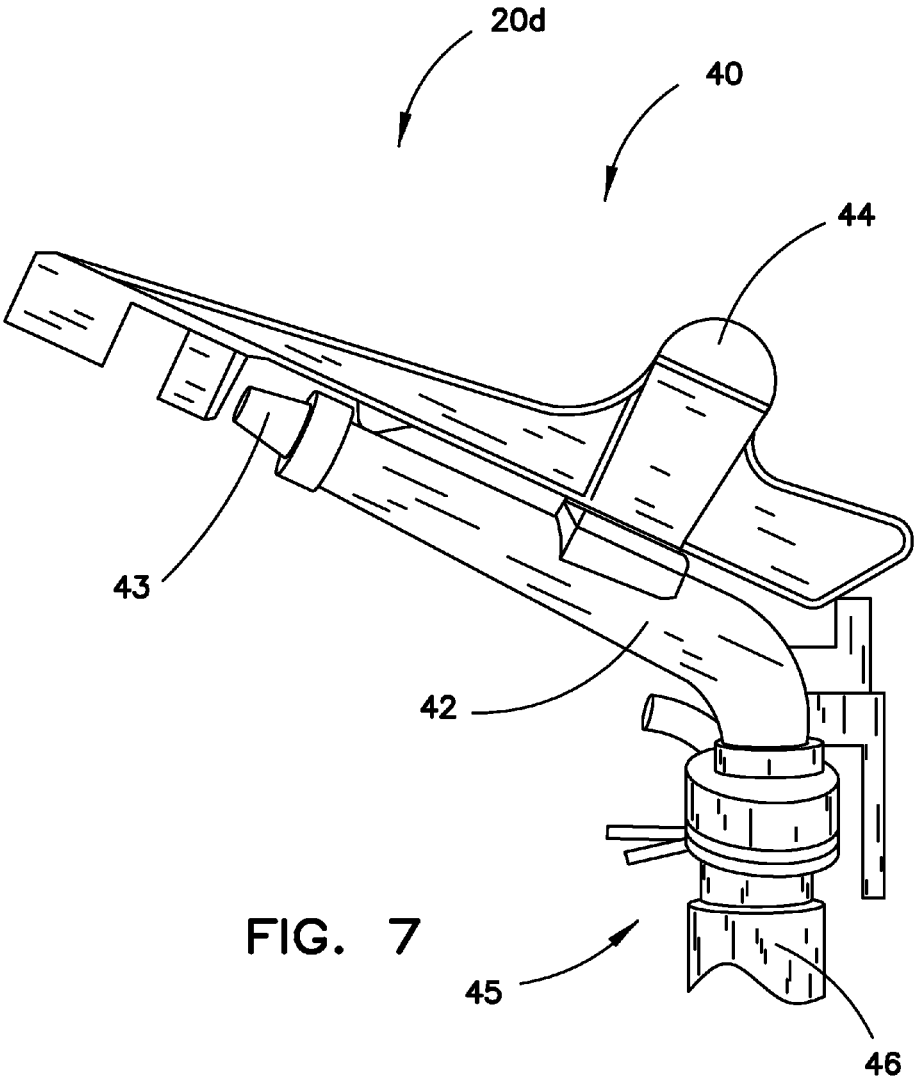
FIG. 7 is a view of a rotating nozzle for the present water ejection spouts according to the present principles.

Referring now to FIG. 7, there is shown an alternate nozzle 40 for yet another exemplary embodiment of a water ejection spout 20*d*. While the nozzle 40 is described with respect to the water ejection spout embodiment 20*d*, it should be appreciated that the nozzle 40 may be used on any of the water ejection spouts described herein. The nozzle 40 is also representative of nozzles that provide a moving or adjustable spray or stream of water from the water ejection spout.

The nozzle 40 is illustrated as a typical rotating (moving) spray head. The nozzle 40 is situated on an end of a tube section 46 of the water ejection spout 20*d*. A curved tube section 42 extends from the tube section 46 and terminates in a water ejection head 43. A spring/rotation mechanism 45 is provided that is coupled to an actuating arm 44. Pressure from the ejected water causes the nozzle 40 to rotate as desired.

Figure 8:
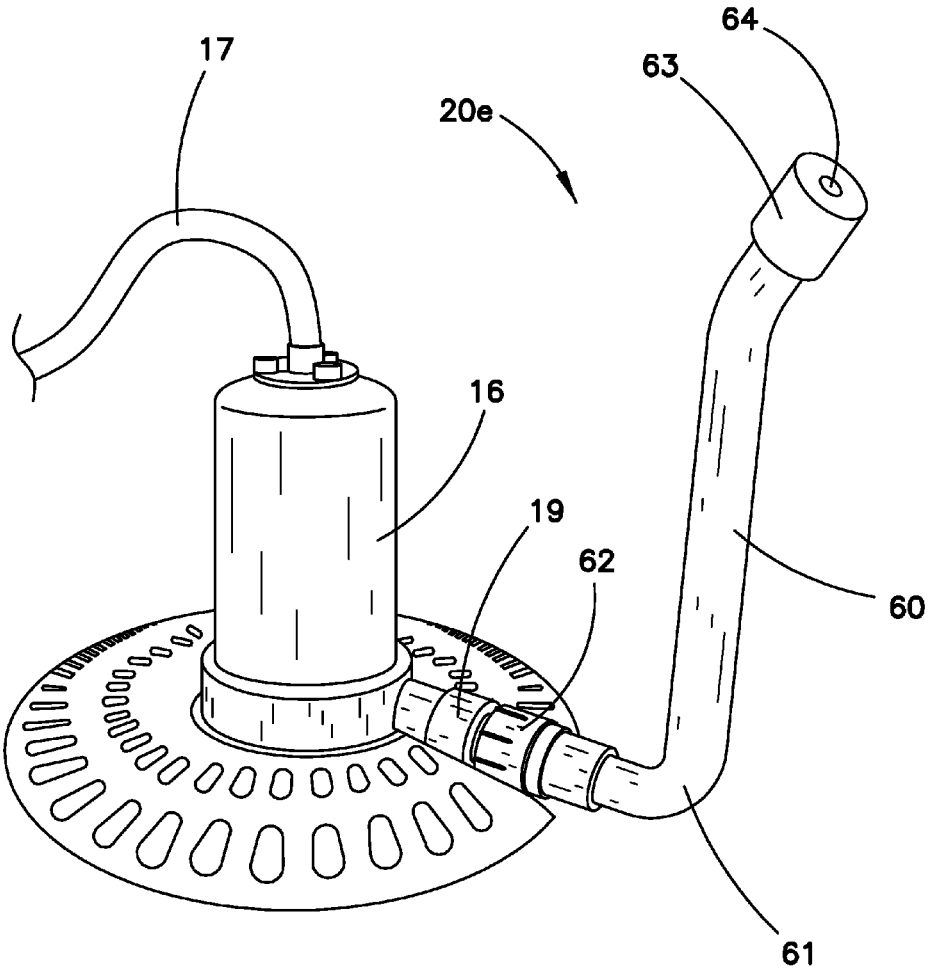
FIG. 8 is a view of another water ejection spout fashioned in accordance with the present principles connected to a pool cover pump.

Referring now to FIG. 8, there is depicted a further embodiment of a water ejection spout 20*e* fashioned in accordance with the present principles that is connected to the pool cover pump 16. The water ejection spout 20*e* is configured to expel and/or disperse the accumulated water in a stream (not shown). The water ejection spout 20*e* includes a threaded connector section 62 that is configured for attachment to the threaded pump connector 19. An angled section 61 extends upwardly and slightly outwardly from the connector section. A length of generally linear (straight) tube 60 extends from the angled section 61 and includes an outward bend at its distal end. A nozzle 63 have an orifice 64 is situated at the end of the bend. The nozzle 63 is configured to eject, expel and/or disperse the outflowing stream of water (not shown) a distance away from the pool 10 and the pool cover 12.

Figure 9:
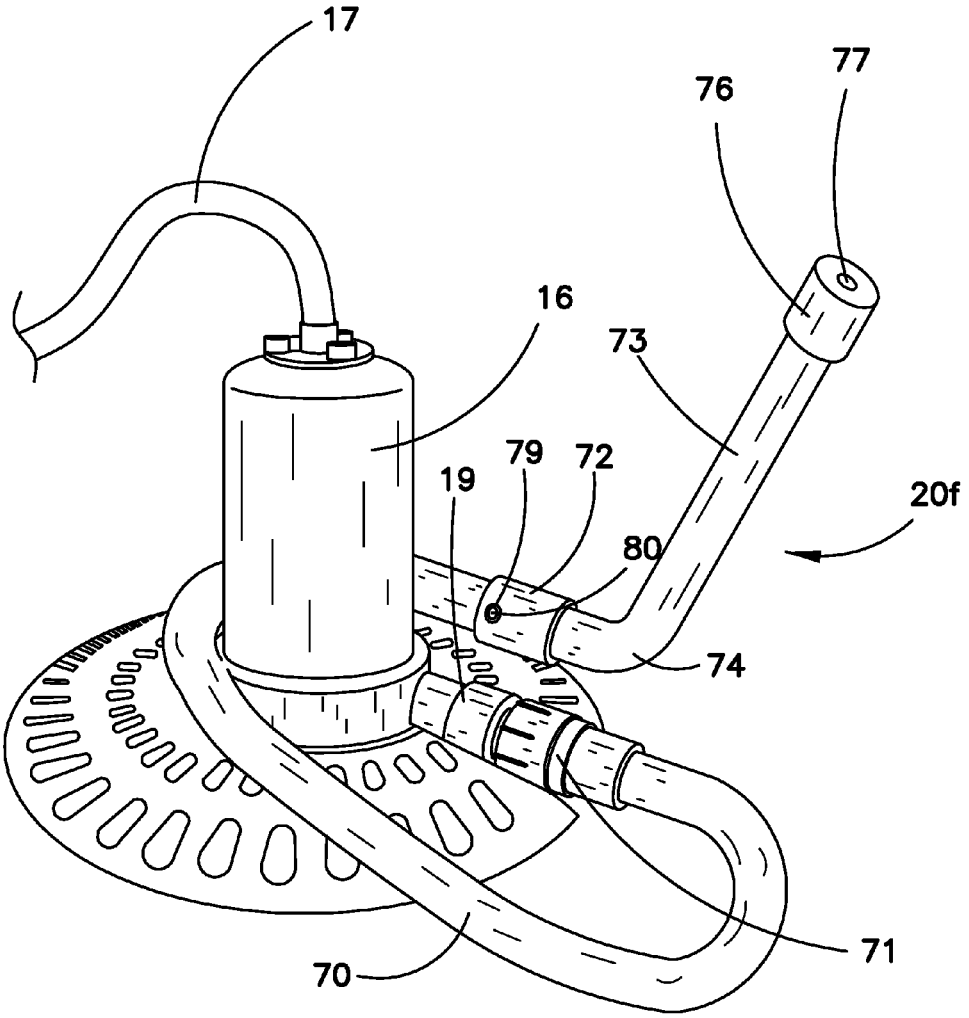
FIG. 9 is a view of another water ejection spout fashioned in accordance with the present principles connected to a pool cover pump.
Figure 10:
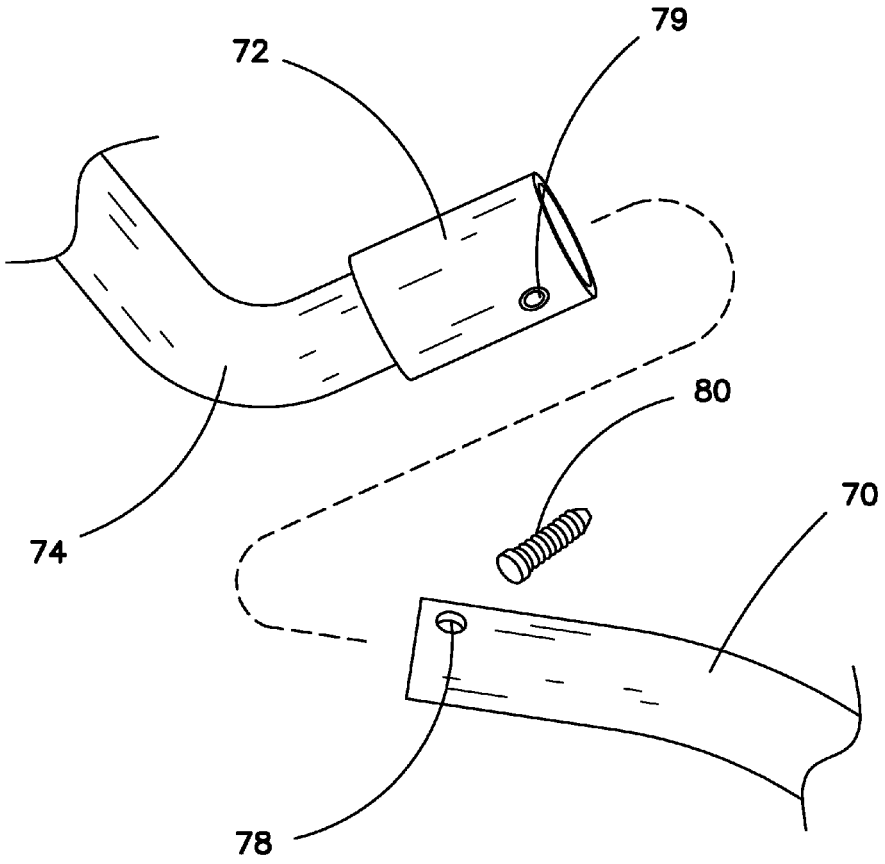
FIG. 10 is an enlarged view of connecting portions of the water ejection spout of FIG. 9.

Referring to FIGS. 9 and 10, there is depicted a still further embodiment of a water ejection spout 20*f* fashioned in accordance with the present principles. The water ejection spout 20*f* is configured to address any possible rotation and/or tipping of the pool pump and connected water ejection spout that can be caused by the pressure of the outflowing water stream or spray. The water ejection spout 20*f* thus provides a water ejection spout that is anti-rotation and anti-tipping to the pump/spout configuration.

The water ejection spout 20*f* includes a threaded connector 71 that is configured to couple to the threaded pump connector 19. A first tube 70 extends from the connector 71 and is shaped to wrap around the pump 16. The first tube 70 has a bore 78 at its distal end. A second tube 73 having a bend 74 and a tube connector 72 at one end is adapted to allow connection of the first tube 70. The tube connector 72 has a bore 79 that aligns with the bore 78 of the first tube 70. A pin 80 or similar device is received in the bores 79 and 80 in order to secure the two tubes 70, 74 together. The tubes/tube sections 70 and 73 are separate to aid in packaging and/or storage of the water ejection spout 20*f*.

Those of skill in the art will understand that various details of the present invention may be changed without departing from the spirit and scope of the invention. Furthermore, the foregoing description is for illustration only, and not for the purpose of limitation, the invention being defined by the claims. Moreover, the various features of the various embodiments shown and described herein may be interchanged as desired.

While the invention has been illustrated and described in detail in the foregoing drawings and description, the same is to be considered as illustrative and not restrictive in character, it being understood that only illustrative embodiments thereof have been show and described and that all changes and modifications that are within the scope of the following claims are desired to be protected.

All references cited in this specification are incorporated herein by reference to the extent that they supplement, explain, provide a background for or teach methodology or techniques employed herein.

What is claimed is:

1. A device for removing water from a swimming pool cover in conjunction with a submersible AC electricity operated swimming pool cover pump having a water outlet with an outlet connector that is threaded for releasable coupling to a correspondingly threaded inlet connector, the device comprising:

a correspondingly threaded inlet connector configured for releasable coupling to the threaded outlet connector of the water outlet of the submersible AC electricity operated swimming pool cover pump;

an ess-shaped tube having a first end and a second end, the first end joined to the correspondingly threaded inlet connector; and a water ejection nozzle disposed at the second end of the ess-shaped tube, the water ejection nozzle having an orifice sized to increase velocity of ejected water over a velocity of incoming water;

the ess-shaped tube and water ejection nozzle configured to expel water from the submersible AC electricity operated pool cover pump outwardly and away from the submersible AC electricity operated pool cover pump, and to allow water within the water ejection nozzle and tube to self-drain into the submersible AC electricity operated swimming pool cover pump when the submersible AC electricity operated swimming pool cover pump is not operating.

2. The device of claim 1, wherein the tube and water ejection nozzle are configured to additionally expel the water from the submersible AC electricity operated swimming pool cover pump upwardly.

3. The device of claim 1, wherein the tubing and nozzle are configured to additionally expel the water from the pool cover pump over the pool cover pump.

4. The device of claim 1, wherein the water ejection nozzle is configured to expel water from the submersible AC electricity operated swimming pool cover pump in a stream.

5. The device of claim 1, wherein the water ejection nozzle is configured to expel water from the submersible AC electricity operated swimming pool cover pump in a spray.

6. The device of claim 1, wherein the ess-shaped tube includes a first portion that extends radially outward from the correspondingly threaded inlet connector, a second portion angling outwardly from the first portion, and a third portion that extends upwardly from the second portion, the water ejection nozzle joined to the third portion.

7. The device of claim 1, wherein the tubing wraps around the pool cover pump.

8. The device of claim 7, wherein the tubing comprises a first tubing portion that extends from the connector and around the pool pump, and a second tubing portion that extends upwardly and outwardly from the first tubing portion, the nozzle joined to an end of the second tubing portion that is distal the first tubing portion.

9. The device of claim 8, wherein the second tubing portion is removably connected to the first tubing portion.

10. A water ejection spout for evacuating water via an AC electricity operated submersible swimming pool cover pump having a threaded water outlet connector, the water ejection spout comprising:

a threaded inlet connector configured for releasable coupling to the threaded water outlet connector of the AC electricity operated submersible swimming pool cover pump;

an ess-shaped plastic tube having a first end and a second end, the threaded inlet connector coupled to the first end; and a water ejection nozzle disposed at the second end of the ess-shaped plastic tube, the water ejection nozzle having an orifice sized to increase velocity of ejected water over a velocity of incoming water;

the ess-shaped plastic tube and water ejection nozzle configured to expel water from the AC electricity operated submersible swimming pool cover pump outwardly and away from the AC electricity operated submersible swimming pool cover pump.

11. The water ejection spout of claim 10, wherein the ess-shaped plastic tube and water ejection nozzle are configure to expel water from the AC electricity operated submersible swimming pool cover pump outwardly and away from the AC electricity operated submersible swimming pool cover pump in a directed stream.

12. The water ejection spout of claim 10, wherein the ess-shaped plastic tube and water ejection nozzle are configure to expel water from the AC electricity operated submersible swimming pool cover pump outwardly and away from the AC electricity operated submersible swimming pool cover pump in a directed spray.

13. The water ejection spout of claim 10, wherein the tube and nozzle are configured to additionally expel the water from the pool cover pump over the pool cover pump.

14. The water ejection spout of claim 10, wherein the ess-shaped plastic tube includes a first plastic tube portion that extends radially outward from the threaded inlet connector, a second plastic tube portion angling outwardly from the first plastic tube portion, and a third plastic tube portion that extends upwardly from the second plastic tube portion, the water ejection nozzle joined to the third plastic tube portion.

15. The water ejection spout of claim 10, wherein the tube wraps around the pool cover pump.

16. The water ejection spout of claim 15, wherein the tube comprises a first tube portion that extends from the connector and around the pool pump, and a second nozzle joined to an end of the second tube portion that is distal the first tube portion.

17. The water ejection spout of claim 16, wherein the second tube portion is removably connected to the first tube portion.

18. A method of removing water from a swimming pool cover, the method comprising:

providing an AC electricity operated submersible swimming pool cover pump having a threaded outlet connector;

connecting a correspondingly threaded inlet connector of a water ejection spout according to claim 10 to the threaded outlet connector of the AC electricity operated submersible swimming pool cover pump;

orienting the water ejection spout to direct expelled water outside of the swimming pool cover; and connecting the AC electricity operated submersible swimming pool cover pump to a source of AC electricity.

* * * * *